United States Patent [19]

Wilmeth

[11] 4,309,923

[45] Jan. 12, 1982

[54] POWER TOOL FOR TORQUING ENCLOSED CONNECTORS

[75] Inventor: Claude H. Wilmeth, Montgomery, Tex.

[73] Assignee: N-S-W Corporation, Austin, Tex.

[21] Appl. No.: 162,460

[22] Filed: Jun. 23, 1980

[51] Int. Cl.[3] ..... B25B 13/50

[52] U.S. Cl. ..... 81/57.34; 81/57.39

[58] Field of Search ..... 81/57.39, 57.16, 57.34

[56] References Cited

U.S. PATENT DOCUMENTS

| | | | |
|---|---|---|---|
| 2,985,455 | 5/1961 | Powell | 81/57.34 |
| 3,041,901 | 7/1962 | Knights | 81/57.34 |
| 3,706,244 | 12/1972 | Wilmeth | 81/57.39 |
| 3,902,385 | 9/1975 | Haby | 81/57.39 |
| 3,955,447 | 5/1976 | Parker | 81/57.39 |
| 4,027,560 | 6/1977 | Parker | 81/57.39 |
| 4,132,136 | 1/1979 | Wilmeth | 81/57.39 |

*Primary Examiner*—James L. Jones, Jr.
*Attorney, Agent, or Firm*—Michael P. Breston

[57] ABSTRACT

The power tool comprises a slit wrench having a pair of semi-cylindrical segments boltable to each other and defining a socket. At least one wrench segment has a laterally and outwardly-extending head defining a plurality of notches having ridges which are rounded and inclined to allow the application of a force thereto as by the rod of a hydraulic cylinder. A reaction-and-support structure serves as a mounting platform for the hydraulic cylinder. This structure also generates the required reaction forces. The rod of the hydraulic cylinder carries a drive pin which applies, during each power stroke of the cylinder, a drive force against consecutive notches, thereby rotating the threaded connector through a small angle during each power stroke of the cylinder.

3 Claims, 10 Drawing Figures

FIG. 1.
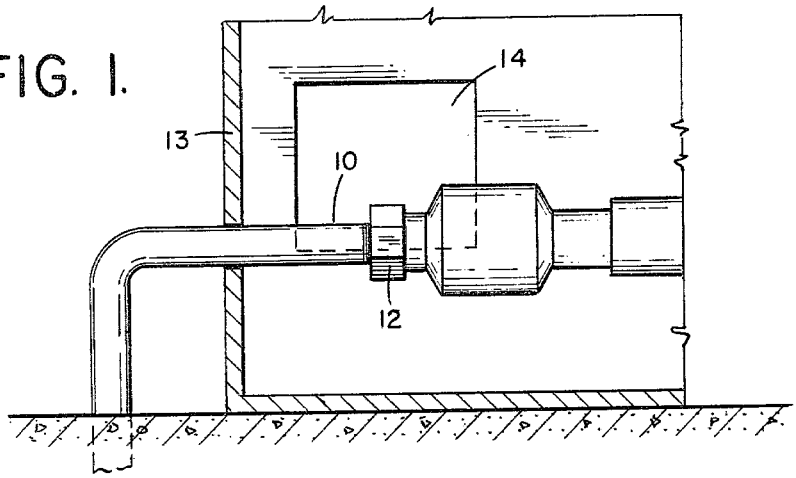
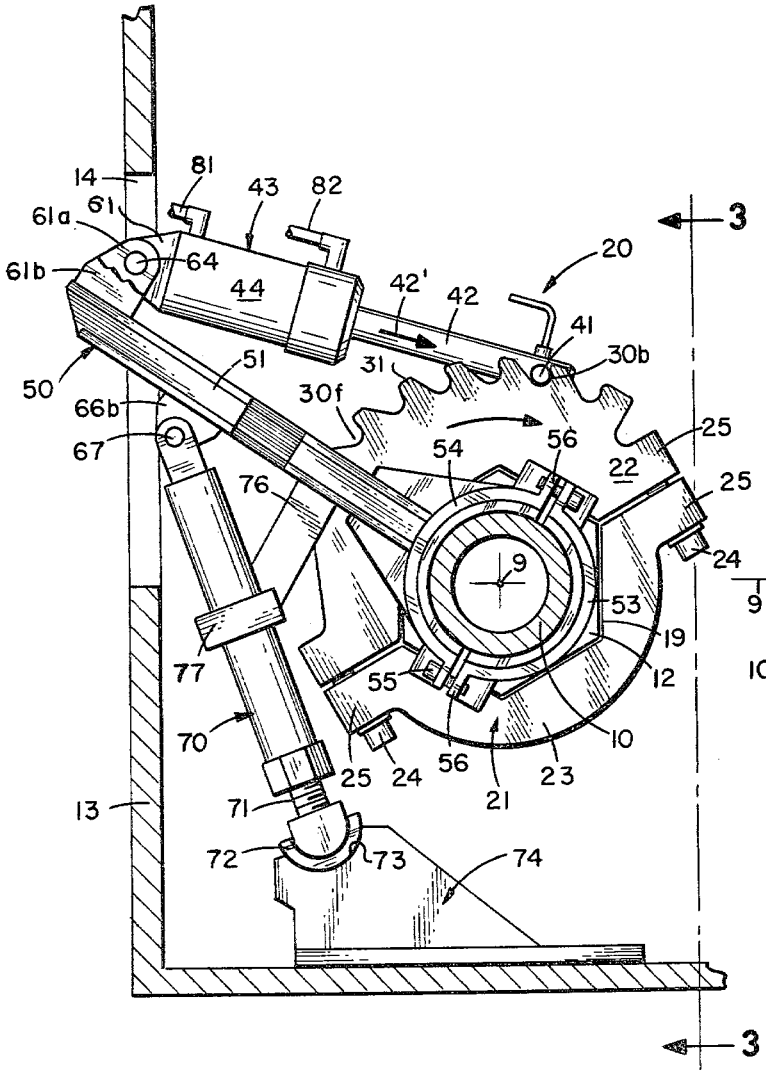
FIG. 2.
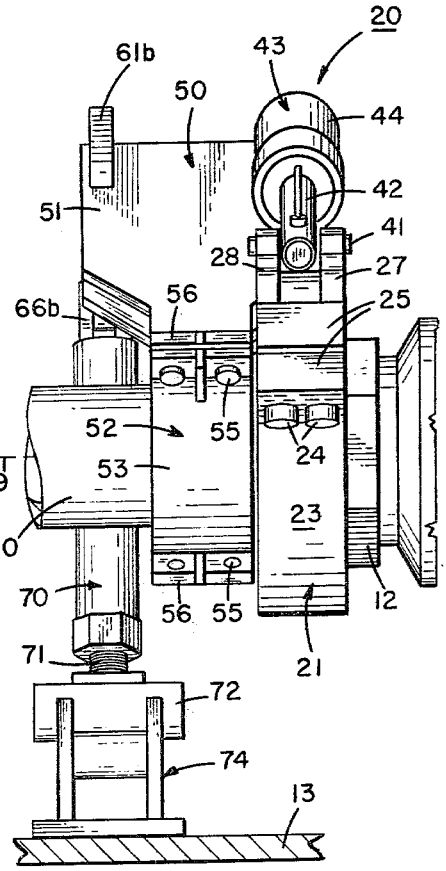
FIG. 3.

FIG. 4.
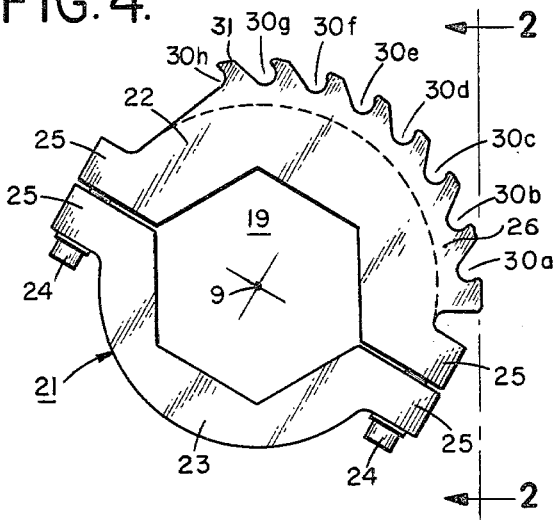
FIG. 5.
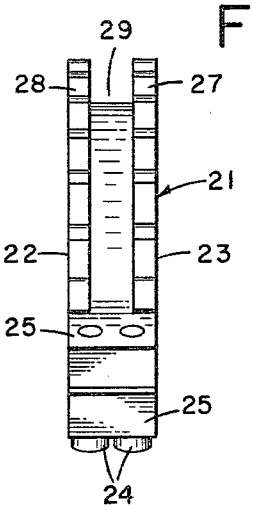
FIG. 7.
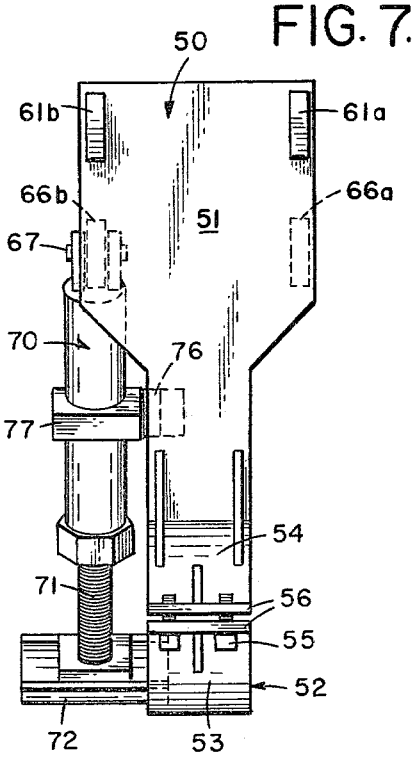
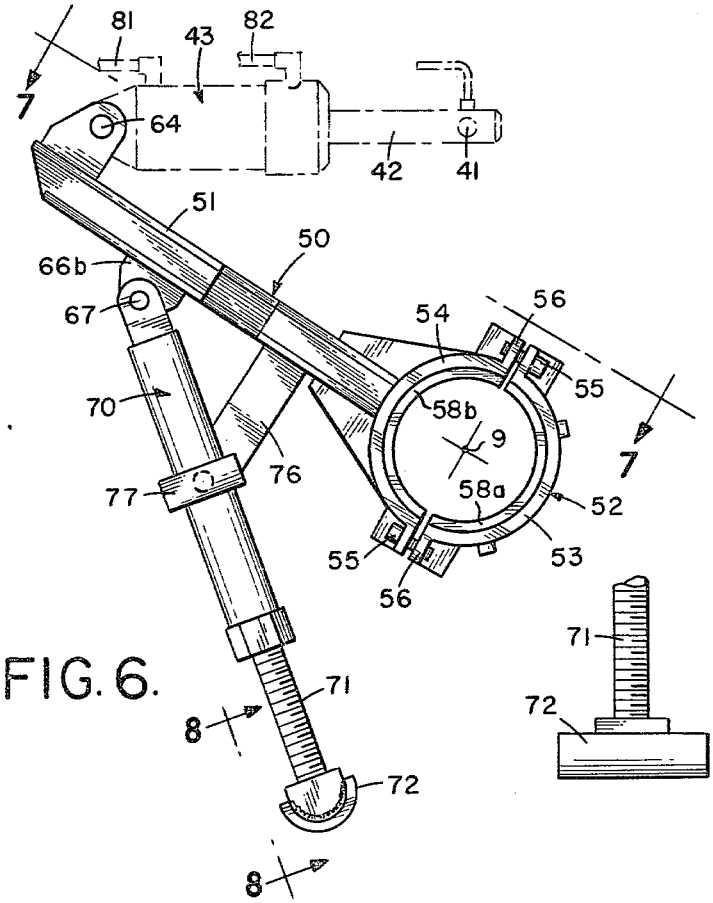
FIG. 6.
FIG. 8.
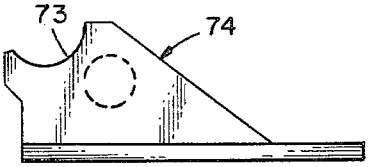
FIG. 9.
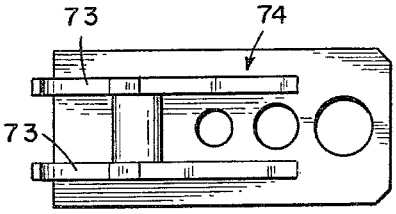
FIG. 10.

POWER TOOL FOR TORQUING ENCLOSED CONNECTORS

BACKGROUND OF THE INVENTION

1. Field of the Invention

The power tool is especially adapted for torquing a threaded connector mounted on an elongated device, which can be confined, for example, in a cylindrical casing having a narrow window through which the tool can be mounted onto the threaded connector.

2. Description of the Prior Art

Power wrenches for threaded connectors, such as bolts and nuts, are described in several U.S. patents assigned to the assignee of the present invention, see for example, U.S. Pat. Nos. 3,706,224, 3,955,447, 4,027,560 and 4,132,136. The assignee's patented tools are mostly characterized in that each includes an integral cylindrical socket which is especially adapted for threaded connectors arranged in a circular pattern on flanges. These tools do not lend themselves for use on a threaded connector mounted on a long tubular device housed within a casing or housing because access to such threaded connector within the casing is frequently limited to a narrow window. When such a threaded connector remains in position for a long time, only a very high-torque wrench can initiate the rotation thereof.

Accordingly, it is a primary object of the present invention to provide a high-torque split wrench which is especially adapted to be mounted on a threaded connector disposed on an elongated device. The novel split wrench lends itself particularly for such elongated devices that may be contained within limited-access enclosures.

SUMMARY OF THE INVENTION

The power tool comprises a split wrench having a pair of semi-cylindrical segments boltable to each other and defining a socket for a particular threaded connector which may be positioned on an elongated device within an enclosure to which access is limited. At least one wrench segment has a radially and outwardly-extending head defining a plurality of notches having ridges which are rounded and inclined to allow the application of a force thereto as by the rod of a hydraulic cylinder. A reaction-and-support structure serves as a mounting platform for the hydraulic cylinder. This structure also generates the required reaction forces. The reaction structure includes a beam. One end of the beam has a split anchor clamp which is adapted to clamp to the elongated device or to an adjacent stationary member. The hydraulic cylinder is pivotably mounted on the beam. One end of an anchor leg is pivotably coupled to the beam. The other end of the leg is movably mounted on an anchor foot adapted to firmly rest against a part of the enclosure which houses the elongated device. The rod of the hydraulic cylinder carries a drive pin which applies, during each power stroke of the cylinder, a drive force against consecutive notches, thereby rotating the threaded connector through a small angle during each power stroke of the cylinder.

BRIEF DESCRIPTION OF THE DRAWINGS

FIG. 1 is a schematic front view of the elongated member carrying a threaded connector within a confined enclosure;

FIG. 2 is a front view in elevation, partly in section, showing the power tool torquing the connector;

FIG. 3 is a side view of the tool shown in FIG. 2;

FIG. 4 is a front view of the socket wrench;

FIG. 5 is an end view of the wrench taken on line 5—5 of FIG. 4;

FIG. 6 is a front view in elevation of the reaction and support structure;

FIG. 7 is a top view of the structure taken on line 7—7 of FIG. 6;

FIG. 8 is a detail view of the anchor leg taken on line 8—8 of FIG. 6;

FIG. 9 is a front view of the anchor foot; and

FIG. 10 is a top view of the anchor foot shown in FIG. 9.

DETAILED DESCRIPTION OF A PREFERRED EMBODIMENT

With reference to the drawings, there is shown an elongated device 10 having a threaded connector 12 mounted thereon. Elongated device 10 is typically contained in a housing or casing 13 to which limited access is provided through a "window" 14 (FIG. 2). Conventional high-torque wrenches are not adapted to be mounted in such a confined environment for rotating the threaded connector 12.

Accordingly, the power tool of this invention, generally designated as 20, is specifically designed to fill a great need for turning a threaded connector positioned on a long device which is contained in a limited access housing. While the power tool 20 of this invention is described in connection with such an elongated device 10, it should be understood that its utility is not limited to the specific application herein described.

The power tool 20 comprises a split socket wrench 21 having a socket 19 formed by a pair of semi-cylindrical wrench segments 22, 23 which are detachably coupled to each other by any suitable means, such as bolts 24 extending through diametrically-opposed, outwardly-projecting lugs 25. At least wrench segment 22 has a radially and outwardly extending head, generally designated as 26, having two spaced-apart parallel plates 27, 28 which form therebetween a channel 29. The outer edges of plates 27, 28 define pairs of angularly-spaced notches 30*a*–30*h* arranged in a circular pattern relative to the longitudinal axis 9 of the socket 19 which is coincident with the longitudinal axis of the elongated device 10. Each notch has a ridge 31 which is rounded and inclined to allow the application of a force 42' thereto by a drive cross-pin 41 carried by the outer end of a rod 42 of a hydraulic cylinder 43 having a casing 44.

Since the application of a drive force onto the wrench head 26 requires reaction stresses, these are obtained from a two-point reaction structure, generally designated as 50 (FIG. 6), which also serves to provide support to the hydraulic cylinder 43. The reaction structure 50 comprises a reaction beam 51 which has at its inner end a reaction clamp, generally designated as 52. The reaction clamp 52 comprises a pair of semi-cylindrical clamp elements 53, 54 which are boltable to each other as by bolts 55 extending through diametrically-opposite lugs 56.

The reaction clamp 52 is adapted to clamp onto the elongated device 10 preferably adjacent to the threaded connector 12. To protect the elongated device 10 against damage, clamp 52 preferably comprises a split inner sleeve made of bronze and having a pair of semi-cylindrical sleeve members 58*a*, 58*b*.

The outer end of reaction beam 51 carries on the top side thereof a pair of mounting eyes 61*a*, 61*b* adapted to receive in either one of them the base 63 of casing 44 of hydraulic cylinder 43. A pivot 64 extends through the eye 61 and the base 63. The bottom side of beam 51 also carries a pair of mounting eyes 66*a*, 66*b* to which is pivotably connected to either one of them on a pivot 67 a reaction leg 70 having an adjustable screw 71 and a bottom semi-cylindrical bearing wall 72 which articulates on a mating bearing surface 73 provided by a reaction foot 74, which, in use, is made to bear against the inner wall of enclosure 13. The length of reaction leg 70 is adjusted by screw 71, thereby discreetly varying the angular position of cylinder 43 relative to the longitudinal axis 9 of connector 12. A lateral brace 76 is detachably coupled between beam 51 and leg 70. The adjustability is provided by a spacer 77.

In operation, cylinder 43 is fluid-operated and has a double-acting piston (not shown) coupled to rod 42 which is adapted to freely slide inside channel 29 of the wrench head 26. The cylinder 43 is controlled by two hydraulic lines 81, 82, each adapted to alternatingly receive fluid pressure from a conventional fluid pressure source (not shown). The amount of pressure received can be varied to obtain the desired torque value. The diameter of drive-pin 41 is such that it can freely move into and out of the notches 30. The pin 41 transmits the force generated by the push rod to that ridge 31 which is engaged by the pin. This force can be a pulling or pushing force depending on the orientation of the notches. In FIG. 2, force 42' is a pushing force.

Prior to starting the operation of the power tool 20, the push rod 42 is contracted. Pressure on fluid line 81 starts the first cycle and causes an extension of the rod 42 which causes the wrench 21 to rotate in a clockwise direction (FIG. 2) about the longitudinal axis 9. For each cycle, that is, full extension of the push rod 42, the wrench will rotate clockwise, say by an angle of about 12°, in the direction of the arrow. Pressure on the other fluid line 82 will end the first cycle by retracting the push rod, causing pin 41 to move down from the first notch 30*a* to the second notch 30*b*. A second extension of the push rod will again cause the wrench to rotate clockwise by 12° and the second retraction of the push rod will move pin 41 down from the second notch 30*b* to the third notch 30*c*. This process is repeated as many times as necessary until pin 41 falls into the last notch 30*h*.

If additional rotation is required, the wrench segments 22, 23 are unbolted and repositioned to again initiate the rotation of the threaded connector 12 by a predetermined angle, (say 90° to 120°) which is equal to the number of notches 30 1 times the angular rotation per notch.

What is claimed is:

1. In a high-torque tool comprising a socket wrench for turning a threaded connector, a fluid-operated cylinder for driving said wrench to thereby rotate said threaded connector, and a reaction structure for supporting said cylinder and for providing the necessary reaction forces to said cylinder, the improvement wherein:

said socket wrench comprises a pair of semi-cylindrical wrench segments boltable to each other and defining a socket at the center thereof, said socket having a shape adapted to receive therein said threaded connector, at least one of said segments having a radially and outwardly extending head defining a plurality of angularly-spaced notches generally arranged in a circular pattern relative to the longitudinal axis of said wrench;

said reaction structure comprising:

a reaction beam having at its inner end an anchor clamp comprised of a pair of semi-cylindrical clamp members adapted to detachably clamp said beam to a first anchor adjacently positioned to said threaded connector, and an adjustable reaction leg having one end pivotably connected to said beam and an opposite end which serves, in use, as a reaction foot adapted to abut against a second anchor adjacent to said connector; and said cylinder being pivotably connected to the opposite end of said reaction beam, and having a rod which consecutively engages said notches to thereby consecutively rotate said wrench.

2. A high-torque tool, comprising:

a socket wrench having a pair of semi-cylindrical wrench segments detachably coupled to each other and defining a socket at the center thereof, said socket having a shape adapted to receive therein a threaded connector which is threadedly coupled to an elongated device having a longitudinal axis extending through the center of said socket;

at least one of said segments having a radially and outwardly extending head comprising two spaced-apart plates which form therebetween a channel, said plates defining pairs of angularly-spaced notches, generally arranged in a circular pattern relative to said longitudinal axis, said notches having ridges which are rounded and inclined;

a fluid operated cylinder;

a two-point reaction structure for supporting said cylinder and for providing reaction forces thereto, said reaction structure including:

a reaction beam having at its inner end an anchor sleeve comprised of a pair of semi-cylindrical sleeve members adapted to detachably embrace and firmly lock to said device adjacently to said socket wrench, an adjustable reaction leg having one end pivotably coupled to said beam and having an opposite end which serves, in use, as a reaction foot to react against a fixed anchor member adjacent to said device, and said cylinder having a casing pivotably mounted on said beam, and having a rod adapted to freely move in said channel between said plates, a drive-pin on said rod whereby during the power stroke of said cylinder said pin will consecutively exert a driving force against said ridges thereby rotating said socket wrench and with it said threaded connector.

3. A high-torque tool, comprising:

a socket wrench having a pair of semi-cylindrical wrench segments detachably coupled to each other and defining a socket at the center thereof, said socket having a shape adapted to receive therein a first element which is coupled to an elongated device having a longitudinal axis extending through the center of said socket;

a fluid operated cylinder;

a two-point reaction structure, which is detached from said socket wrench, for supporting said cylinder and for providing reaction forces thereto, said reaction structure including:

a reaction beam having at its inner end an anchor sleeve comprised of a pair of semi-cylindrical sleeve members adapted to detachably embrace and firmly lock to a second element on said device adjacently to said first element;

an adjustable reaction leg having one end coupled to said beam and having an opposite end which serves, in use, as a reaction foot to react against a fixed anchor member adjacent to said device, and said cylinder having a casing mounted on said beam.

* * * * *